US006761100B1

(12) United States Patent
Oncken

(10) Patent No.: US 6,761,100 B1
(45) Date of Patent: Jul. 13, 2004

(54) STUD CUTTER

(75) Inventor: Harold Oncken, Hermann, MO (US)

(73) Assignee: Oncken Machine Service, Inc., Hermann, MO (US)

( * ) Notice: Subject to any disclaimer, the term of this patent is extended or adjusted under 35 U.S.C. 154(b) by 0 days.

(21) Appl. No.: 10/190,117

(22) Filed: Jul. 2, 2002

(51) Int. Cl.[7] ..... B26D 7/02
(52) U.S. Cl. ..... 83/454; 83/465; 83/694
(58) Field of Search ..... 83/453, 456, 464, 83/465, 466.1, DIG. 2, 694, 466, 444, 452, 457, 458, 454, 451

(56) References Cited

U.S. PATENT DOCUMENTS

| | | | | | |
|---|---|---|---|---|---|
| 392,662 | A | * | 11/1888 | Carnahan | 83/694 |
| 438,252 | A | * | 10/1890 | Koehler | 83/456 |
| 1,884,001 | A | * | 10/1932 | Lewis | 83/456 |
| 2,776,003 | A | * | 1/1957 | Koster | 83/54 |
| 3,771,401 | A | * | 11/1973 | Jasinski | 83/453 |
| 4,055,096 | A | * | 10/1977 | Borzym | 83/694 |
| 4,250,782 | A | * | 2/1981 | Munker | 83/454 |
| 4,875,274 | A | | 10/1989 | Foster | |
| 6,116,131 | A | | 9/2000 | Fasske | |
| 6,357,327 | B1 | * | 3/2002 | Usui et al. | 83/466.1 |

FOREIGN PATENT DOCUMENTS

| | | | |
|---|---|---|---|
| DE | 3707175 | * | 9/1988 |

* cited by examiner

*Primary Examiner*—Stephen Choi
(74) *Attorney, Agent, or Firm*—Polster, Lieder, Woodruff & Lucchesi

(57) ABSTRACT

A guillotine type stud cutter with a frame with side rails and a guillotine blade slidably mounted between the rails has spaced, fixed, parallel, stationary die plates secured transversely between the side rails. Immediately inboard of the stationary die plates, sets of spaced parallel shear plates are slideably mounted for movement transversely of the side rails and toward and away from one another. The shear plates have opening defined by wall margins with sharp edges substantially perpendicular to an inside surface of the shear blades, to receive sheet metal studs of different sizes.

10 Claims, 5 Drawing Sheets

STUD CUTTER

CROSS REFERENCE TO RELATED APPLICATIONS

STATEMENT REGARDING FEDERALLY SPONSORED RESEARCH OR DEVELOPMENT

Not Applicable

BACKGROUND OF THE INVENTION

Guillotine type construction industry stud cutters are well known commercially. In the cutters now known, a pair of spaced die blades, with openings in them to accommodate different widths of studs have been fixedly mounted within a frame. A guillotine blade moving through the space separating the plates, sheers the stud. In the present application, "stud" is used generically to encompass not only studs used in the walls of buildings, but also floor joists, rafters, gutters, and the like trough-like shapes.

One of the problems with the machines known heretofore arises from the fact that although studs are supposed to come in a variety of standard sizes, the fact is that they vary in width from the standard. Thus, a 3½ inch wide stud may in fact be 3⅜ or 3⅝ inches wide. In order to accommodate these variations, the openings in the die blades have had to be made wider than any but the largest of the off-sizes for each of the standards; then when a relatively narrow stud is inserted, when the guillotine blade, which has a v-shaped center tooth, comes down, it tends to splay the sidewalls of the stud at the end at which it is cut, and if the largest of the off-sized stud of that standard is cut, the blade tends to bend down the inwardly extending flanges of the stud. Neither of these is desirable. In fact, with most commercial machines, the flanges are unsupported during the cutting, so that they tend to be bent down in any event.

One of the objects of this invention is to provide a machine in which the stud is supported against splaying and the flange is supported against being bent down, regardless of the variation, within limits, from the standard width.

Other objects will become apparent to those skilled in the art in light of the following description and accompanying drawings.

BRIEF SUMMARY OF THE INVENTION

In accordance with this invention, generally stated, in a guillotine blade type stud cutter, with side rails between which the blade moves in a direction lengthwise of the rails, spaced, fixed, parallel back-up or stationary die plates are secured transversely between the side rails. Immediately inboard of the stationary die plates, spaced parallel punch or shear plates, spaced closely to receive between them the blade, are mounted for sliding movement toward and away from one another transversely of the side rails, i.e., parallel to the pairs of stationary die plates. In this embodiment, the stationary die plates have openings in them to receive the walls and flanges of studs of all expected variations in width from the standard of various standard widths. The shear plates also have openings in them, and both the stationary die plates and the shear plates have lip openings to receive the flanges of the studs. Because the shear plates are movable transversely of the machine frame, a stud can be put into the opening, the plates moved until they engage the sidewalls of the stud and then backed off a very small amount, so that the next stud of the same lot can be slid into place without readjusting the spacing of the shear plates. If the side walls of the stud extend at an obtuse angle from a bottom wall, the "vertical" openings or slots can be angled complementarily. Both are embraced within the term "substantially vertical" as used to describe the side wall slots in the stationary die plates and shear plates. The flanges of the stud are supported on lip opening defining facing surfaces of the shear plates. The stud to be sheared is supported by the shear plates well within the elastic limits of the stud's side walls and flanges, so that no splaying of the side walls or permanent bending of the flanges is produced during the shearing process. Generally, all of the studs of a given lot have the same width. If they do not, it is an easy matter to readjust the position of the shear plates.

In the preferred embodiment, a support arm is provided, projecting perpendicularly from the machine frame, and centered with respect to the cutting blade. Studs with closed bottoms aligned along an upper surface of the support bar, can be slid into the slots of the stationary die and the shear plates. An indexing pin is movably mounted along the support bar and clamped in position, so that, when the pin, which is normally spring-biased to that position, is projecting above the surface of the bar, a stud can be pushed against it to position the stud for the exact length desired. The pin is actuated in response to the cutting movement of the blade to retract from its indexing position above the surface of the support bar, so that the stud can easily be withdrawn.

DETAILED DESCRIPTION OF THE PREFERRED EMBODIMENT

Figure 1:
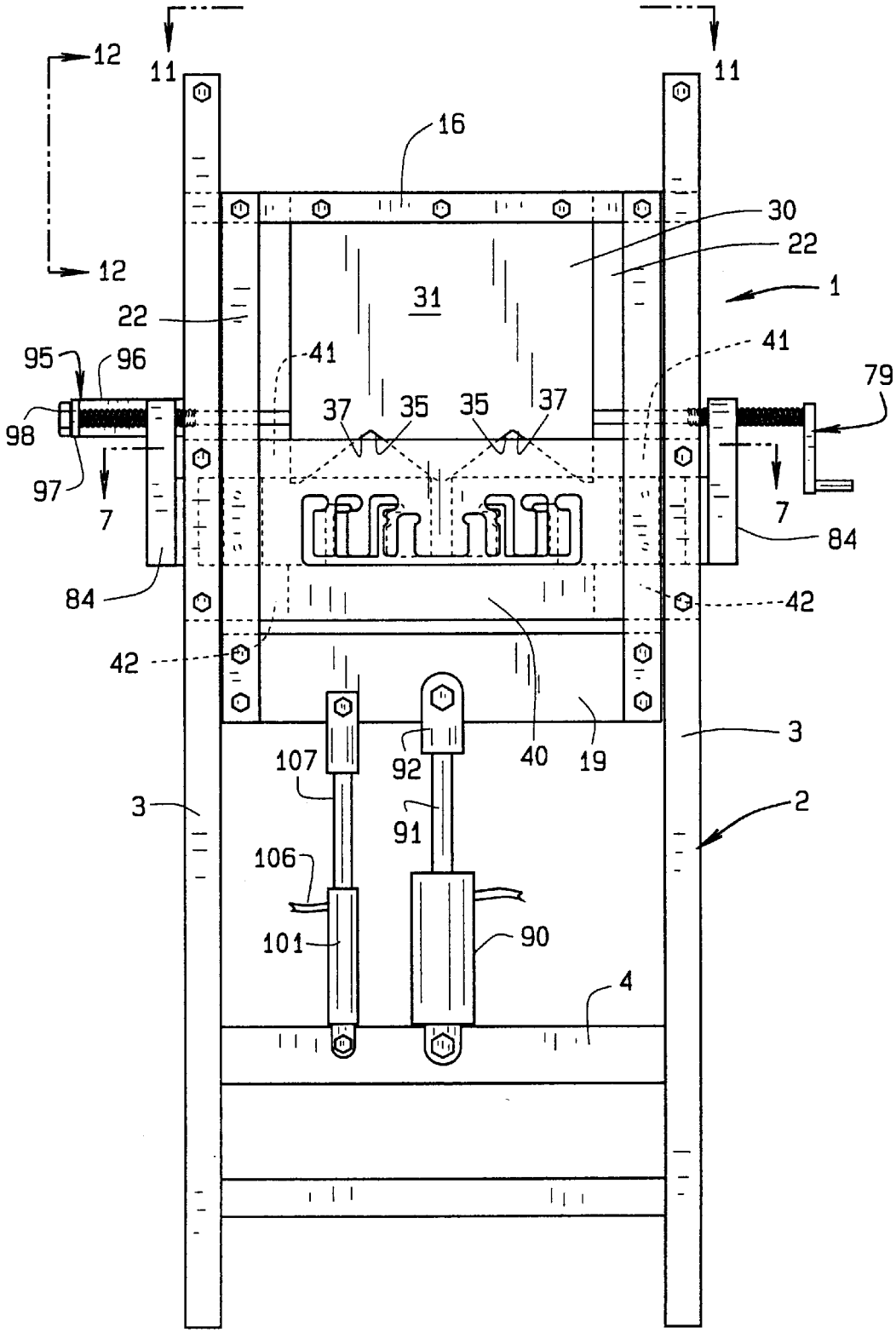
FIG. 1 is a view in front elevation of one embodiment of machine of the present invention.
Figure 2:
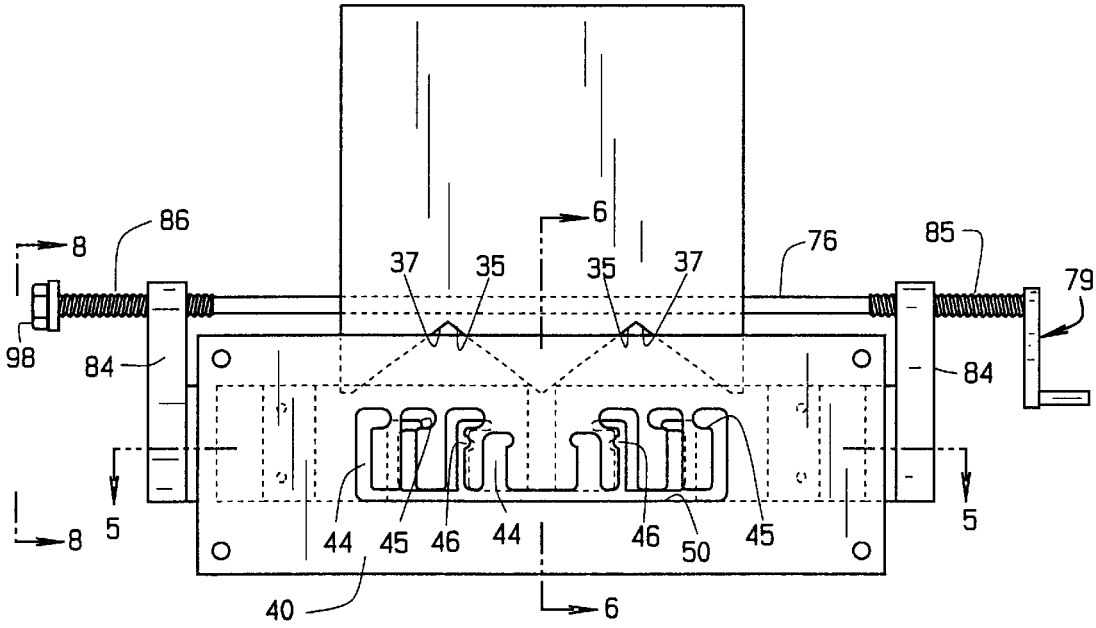
FIG. 2 is a somewhat enlarged view in front elevation of a stationary die plate and sliding shear plate assembly.
Figure 3:
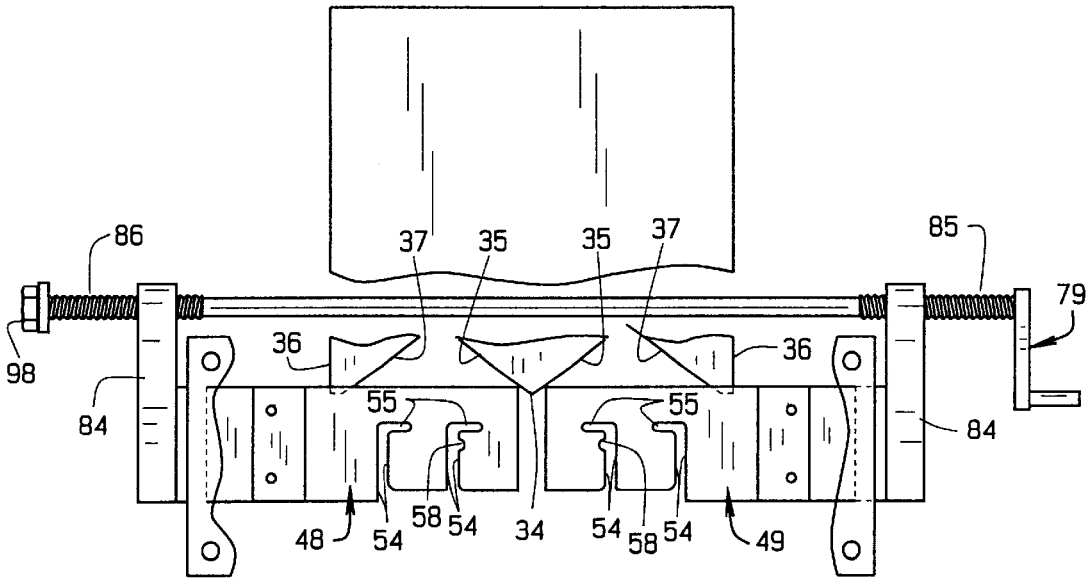
FIG. 3 is a fragmentary view in front elevation of the assembly shown in FIG. 2, with a front stationary die plate and blade partly broken away, showing shear plates in one position.
Figure 4:
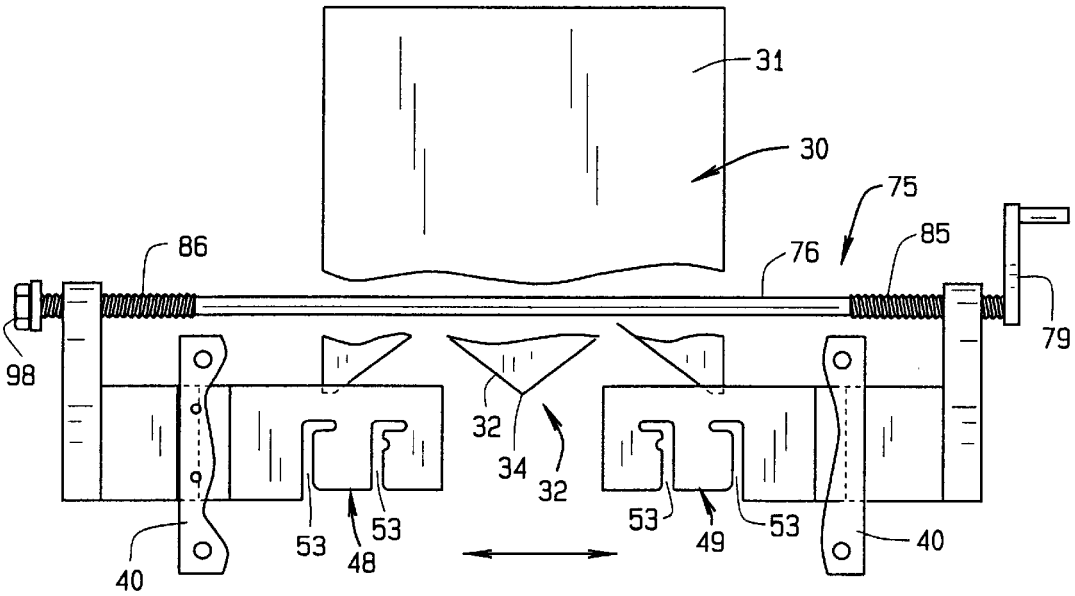
FIG. 4 is a view in front elevation of the assembly as shown in FIG. 3, showing the shear plates in a second position.
Figure 5:
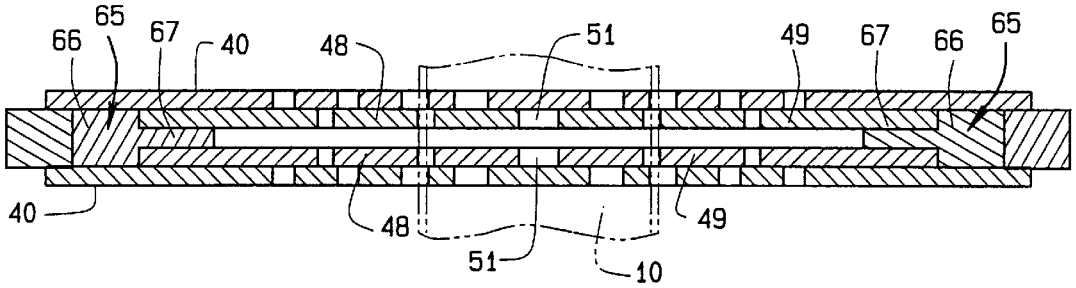
FIG. 5 is a sectional view taken along the line 5—5 of FIG. 2, with a fragmentary stud shown in phantom lines.

Referring now to the drawing for one illustrative embodiment of this invention, reference numeral 1 indicates the stud shearing mechanism of an assembled machine. The machine itself includes a cabinet, not here shown, which supports the mechanism 1, and contains a hydraulic pump, among other things, but this is conventional in such machines. The mechanism 1 has a supporting frame 2 with side rails 3 and a base bar 4. The side rails 3 are made up of two heavy, spaced, parallel plates 5, as is the base bar 4. A spacer plate extends across the base bar, between the two plates making up the base bar. Intermediate spacers, in the embodiment shown, in the form of spools, and top spacers 9, in the form of spools like the intermediate spools, hold the side rails parallel to one another.

A blade frame 14 is constructed to slide between the side rails 3. The blade frame has a top cross piece or header 16, made up of spaced plates spaced to receive a blade 30 and dimensioned to extend slidably between the bars making up the side rails. Bolts through the header plates secure the blade to the header. The blade frame 14 has a bottom cross piece 19 with a hole vertically aligned with a hole in the base bar. Straps 22 are attached to and extend between the bottom cross piece 19 and the header 16. Outer edges 23 of the straps ride against an inboard edge of the side rails 3, serving to hold the blade 30 centered. The blade 30 has a web 31 secured at its upper end to the top cross piece 16, and at its lower edge, has teeth 32, made up of a center tooth 33 with a point 34, and edges 35 forming a shallow V, and side teeth 36 with edges 37, meeting the edges 35 of the center teeth in a slightly obtuse angle.

Figure 6:
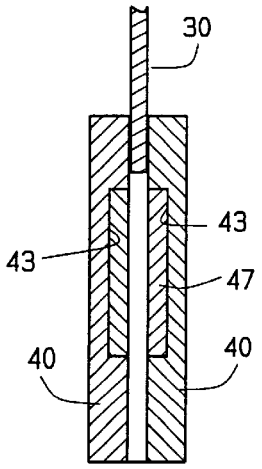
FIG. 6 is a sectional view taken along the line 6—6 of FIG. 2.
Figure 7:
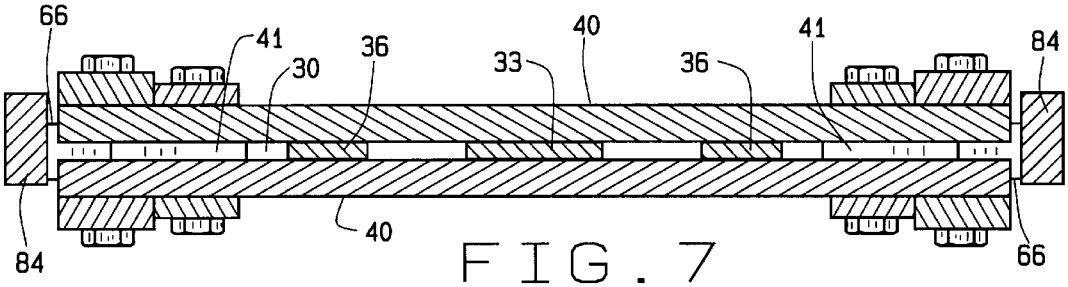
FIG. 7 is a sectional view taken along the line 7—7 of FIG. 1.
Figure 8:
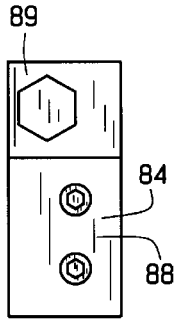
FIG. 8 is a view in end elevation taken along the line 8—8 of FIG. 2.
Figure 9:
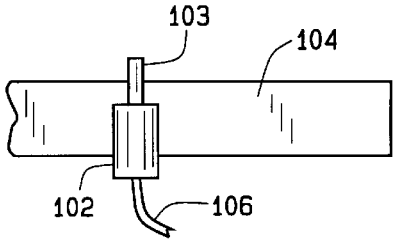
FIG. 9 is a fragmentary view in side elevation of a support and indexing fixture connected to the machine of FIG. 1, showing an indexing finger in a stop position.
Figure 10:
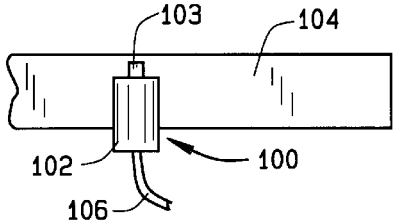
FIG. 10 is a fragmentary view in side elevation showing the indexing finger in retracted position.
Figure 12:
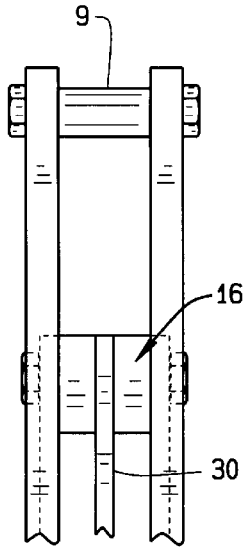
FIG. 12 is a fragmentary view in side elevation taken along the line 12—12 of FIG. 1.

A pair of heavy stationary die plates 40 extend transversely of the side rails 3 above the bottom cross piece 19. The plates 40 are elongatedly rectangular, and are separated by upper spacer block guides 41 and lower spacer block guides 42 which, along a vertical inboard surface, also serve as guides to the edges of the blade web. The stationary die plates are separated just far enough slidably to admit the blade 30, with, for example, 0.002" clearance, as shown particularly in FIG. 6. On their inboard broad surfaces, the stationary die plates have channels 43, opening at each outer end of the stationary die plates. Sliding shear plate assemblies 47 are mounted in the channels 43. Stud-admitting openings 44 in the two plates making up the pair of stationary die plates are exactly aligned front to back. The openings 44 are sharply defined. Each opening has vertical components defining an opening wide enough to admit studs that vary from the standard width within the expected range, a lip 45 to receive a flange, and, to accommodate a common stud with shorter end walls, one pair of openings is shown with a supplemental lip 46. The individual vertical slots in the stationary die plates end above a continuous lower horizontal slot 50. The lower edge of the slot 50 on each of the die plates 40 is defined by an upwardly facing surface that serves to support the stud during the shearing of the stud. Sharp inner edges of the upwardly facing surfaces of the stationary die plates serve as the die which, as the blade 30 passes by, shears the web constituting the bottom of the stud.

The shear plates assemblies 47 are made up of two, spaced, left shear plates 48 and two, spaced, right shear plates 49, the left and right shear plates being mirror images of one another. Both of the shear plates 48 and 49 are elongatedly rectangular, and are seated slidably in the channels 43, which are deep enough to permit the shear plates 48 and 49 to fit with facing surfaces flush with the inboard facing faces of the stationary die plates 40. The two plates making up each of shear plates 48 and 49 are therefore spaced to receive the blade 30 closely but slidably. The shear plates 48 and 49 have in them paired, mirror-image openings 53 defined by sharp, abrupt edges, vertical edges 54 and horizontal lips 55. The openings 53 have the same contour as openings 44 in the stationary die plates 40, including a supplemental lip 58 corresponding to the lip 46 in the stationary die plates, but the plates 48 and 49 have no cross piece defining a slot corresponding to the slot 50 in the stationary die plates, the shear plates moving toward and away from one another in use. The openings 53 are open at their lower ends.

In this embodiment, each of the sliding shear plates 48 and 49 is secured to a shear plate end cap 65 at its outer end. The end cap 65 includes a block 66, the height of the shear plates, and a tenon-spacer 67 integral with block 66 and extending between the plates of each of the shear plates a distance sufficient to permit the shear plates to be securely connected to it. The shear plates are made of hardened steel, for example, D-2 steel with a Rockwell hardness of 58 to 60. The end cap 65 can be made of mild steel.

An operating mechanism 75 includes a screw rod 76 with right hand threads.85 at a handle end and left hand threads 86 at an opposite, bearing end. Screw receiving blocks 84 are fastened to an outboard surface of the end cap block 66. The screw receiving blocks 84 are wider than the end cap blocks 66, and extend flush with one long side of the end cap blocks and along and beyond the opposite side of the end cap blocks 66. The screw receiving blocks 84 have a flat part 88 bolted to the end cap block 66 and a part 89 projecting above the block 66. An internally threaded hole in each of the projecting parts 89 to receive the threaded parts of the screw rod 76 is offset from the end cap block 66 far enough to permit the rod 76 to clear the blade 30, the rod 76 extending between the blade and one of the straps 22. The threaded holes in the projecting part are threaded appropriately for the threads of the rod 76.

A screw end-receiving, L shaped bracket 95, with a long leg 96 fixed to the frame and a short leg 97 at right angles to the long leg, positioned to receive the outer end of the screw rod, has a bearing passage to receive a bearing surface of the screw rod at its free, bearing, end, which also has, at its outermost end, a nut-receiving thread on which a nut 98 is mounted.

A crank handle 79 is connected to the screw rod at the end of the rod opposite the bearing end. Because the threads at opposite ends of the screw rod are oppositely handed, when the crank handle 79 is turned, the shear plates 48 and 49 move toward or away from one another.

Figure 13:
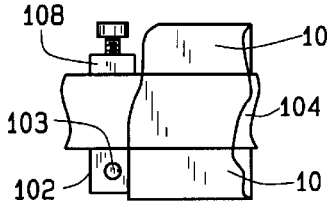
FIG. 13 is a fragmentary bottom plan view of the indexing device of FIGS. 9 and 10, showing one embodiment of clamp for holding the index cylinder along the support.
Figure 11:
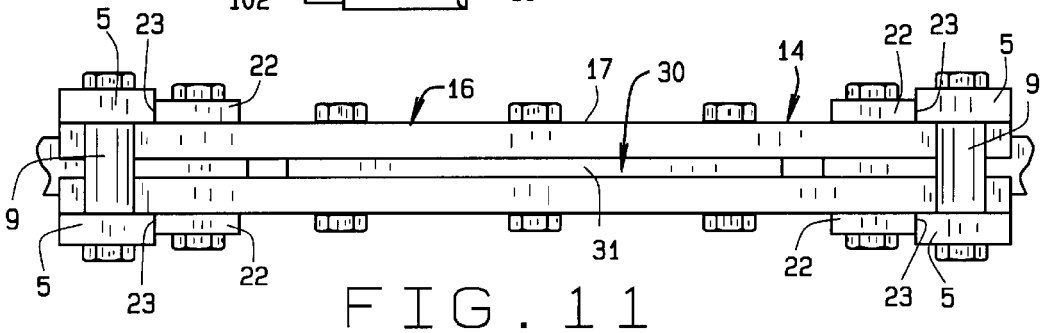
FIG. 11 is a top plan view, taken along the line 11—11 of FIG. 1.

A hydraulic cylinder 90 is connected at its lower end to the base bar 4. A piston 91, carried by the hydraulic cylinder 90, is connected by a clevis 92, at its upper end to the bottom cross piece 19 of the blade frame 14. The hydraulic cylinder 90 is connected to a source of hydraulic fluid pressure, not here shown. When hydraulic fluid is admitted to an upper chamber of the cylinder 90, the piston is forced down, pulling the blade frame, hence pulling the blade through the space betwen the shear plates 48 and 49, thence between the stationary die plates below the slot 50, shearing and stud 10 extending between them. When hydraulic fluid is admitted to a lower chamber of the cylinder 90, the piston is moved back up to its ready position. A smaller fluid cylinder 101, acting as a pump, is connected to the base bar 4, and has a piston 107 connected at its upper end to the bottom cross piece 19. The cyliner 101 is connected by a fluid line 106 to a cylinder 102 of an indexing pin assembly 100. The cylinder 102 actuates an indexing pin 103. The indexing pin assembly is mounted on a long support bar 104, to be selectively positioned along the length of the long support bar 104. In FIG. 13, a C-clamp 108 is shown as connected to the cylinder 102 and embracing the bottom and two sides of the support bar, to permit the cylinder to be held at any desired position along the support bar, although any suitable clamping device can be used. The support bar 104 is connected at one end to the frame of the machine. The top surface of the support bar is level with the lower horizontal portion 50 of the openings in the stationary die plates, so that a stud placed with its flat bottom wall on the support bar, can be slid directly into the appropriate slots in the stationary die plates with its bottom resting on the top of the wall defining the bottom of the horizontal portion 50, or, if the stud is being fed from the opposite side, can be supported by the support bar as it emerges from the slots. The distance from the end of the stud to the blade is determined by the impingement of the end of the stud against the indexing pin, which is normally biased to project above the upper surface of the support bar. When the blade is pulled down by the hydraulic cylinder 90 and its piston, to shear the stud, the piston 107 of the cylinder 101 moves down in the cylinder, and its action pulls the indexing pin down out of the way of the stud, so that the stud can be slid along the support bar and removed to make way for the next stud.

As has been explained heretofore, the shear plates 48 and 49 are moved, by turning the crank handle 79, either toward or away from one another, to accommodate the width of the stud to be sheared, at which point the flanges of the stud are supported by the ledges 45 and the side walls of the stud are constrained by the side walls of the vertical slots of the shear plates.

Figure 14:
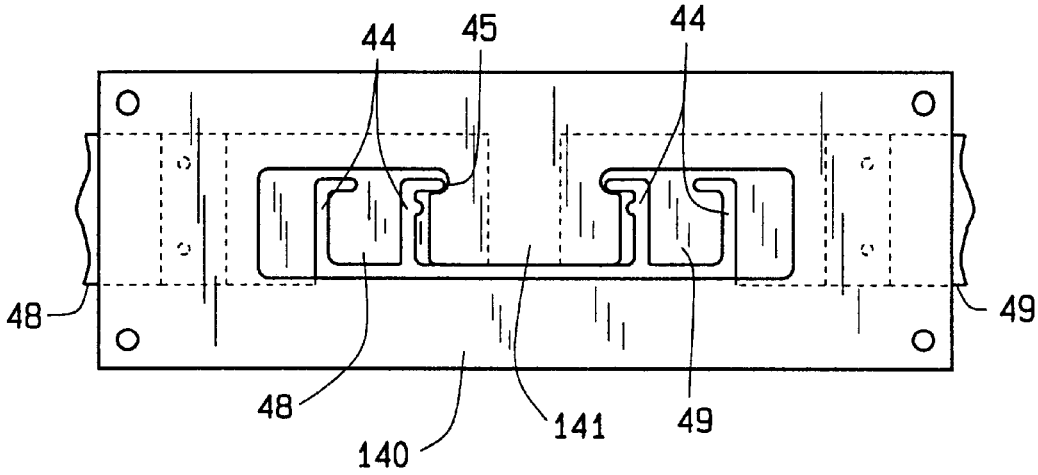
FIG. 14 is a fragmentary view in front elevation of another embodiment of stationary die plate.

Referring now to FIG. 14 for another embodiment of stationary die plates, instead of having individual openings cut in the plates, the area occupied by individual openings in the stationary plates of the first embodiment is all cut away, leaving a central island 141 to provide lateral support for the shear plates 48 and 49, and leaving a supporting area 140, a central section of which defines the opining 50, as in the embodiment first described and, outboard of the central section, area, lower margins of the channels 43, also as in the embodiment first described. This configuration is easier to fabricate, and provides all the support necessary for the shear plates.

Numerous variations in the construction and operation of the machine of this invention, within the scope of the appended claims, will occur to those skilled in the art in the light of the foregoing disclosure. Merely by way of example, the threads on the screw rod can be reversed, with the threads at the handle end being left hand, and the threads at the bearing end, right hand. The configurations of the slots in the stationary die and die plates can be varied to suit the configurations of the studs to be sheared, as for example gutters, or studs with rolled edges, or H beams (in which case, the lower slot 50 can be modified as well). The height of the slots and position or configuration of the lips 45 can also be varied, to suit the height of the side walls of different studs and the configuration or width of the inturned flanges. The numbers of slots can also be varied, to accommodate different studs. The mechanism by which the die plates are moved can be different from the screw rod arrangement shown, as, for example, by the use of hydraulic cylinders and pistons or by electrically driven worm drives. The channels in the stationary die plates and the upper and lower edges of the die plates can be complementarily chamfered to dovetail, to ensure that the die plates do not move in a direction front to back with respect to the stationary die plates. The block 84 need not be offset through its entire length; it can be L shaped, carrying an ear at its upper end that has a threaded hole in it offset from the block 66 to receive the screw rod at each end. Although the arrangement described is by far preferred, stationary die plates themselves can be divided, the continuous slot 50 made discontinuous, and the stationary die plates constructed to move toward and away from one another, supported by L shaped cross members between the side rails, for example. An upper surface of a lower L shaped cross member can serve the function of the upwardly directed surface 51 of the slot 50. When the stationary die plates are made movable, the stationary die plates become shear plates. The indexing pin can be actuated electrically, as by using a switch, thrown when the blade moves down, to energize a solenoid to pull the pin down. These variations are merely illustrative.

Having thus described the invention, what is claimed and desired to be secured by Letters Patent is:

1. In a guillotine type stud cutting machine having a frame with spaced parallel side rails and a guillotine blade slidably mounted between said rails for movement in the lengthwise direction of said side rails, the improvement comprising fixedly spaced, parallel stationary die plates secured transversely between said side rails, said stationary die plates having stud-receiving openings in them, and, immediately inboard of said stationary die plates, spaced, parallel shear plates, spaced closely to receive between them the said blade, said shear plates being slidably mounted for movement transversely of said side rails, parallel to said pairs of stationary die plates, said shear plates having a plurality of pairs of openings, aligned transversely of the space between the shear plates, defined by wall margins, with sharp edges substantially perpendicular to a broad inner surface of said shear plates, said openings corresponding in shape and size to sheet metal studs of various widths, said studs having a bottom web, side walls and, at an outer edge of said side walls, inboardly extending flanges, and means for moving said shear plates transversely of said side rails toward and away from one another.

2. The improvement of claim 1 wherein said stationary die plates have a horizontal opening below the openings in the shear plates, an upwardly facing surface of which horizontal opening receives a bottom surface of a stud being sheared and abrupt facing edges of which surface cooperate with the blade to shear the said bottom web.

3. The improvement of claim 1 wherein the means for moving said shear plates is a screw threaded shaft, provided at one end with right hand threads and at another end with left hand threads, said shaft being mounted in screw bosses carried by said shear plates, and, at one end, mounted for rotation in a fixed supporting bracket carried by one of said side rails whereby said shear plates are moved toward and away from one another when said shaft is rotated.

4. The improvement of claim 1 wherein said stationary die plates have an inner surface and channels in said inner surface in which said shear plates are slidably mounted.

5. The improvement of claim 4 wherein the said channels are deep enough to permit an inboard broad surface of each of said shear plates to lie substantially flush with the inner surface of the stationary die plate in which it is mounted, said stationary die plates being spaced to slidably admit said blade.

6. The improvement of claim 4 wherein said stationary die plates channels in which said shear plates are slidably mounted are as deep as the shear plates are thick, whereby inner surfaces of the shear plates are flush with inner surfaces of the stationary plates.

7. The improvement of claim 1, including a support and guide bar fastened to and projecting at right angles from said frame, positioned with an upper surface at a level of an upper edge of a stud-receiving horizontal opening in said stationary die plates, centered transversely of said side rails of said frame, so that a stud placed with its web on the said upper surface can be slid into a pair of stud-receiving openings in said die plates, and an indexing stop in the form of a finger, biased to extend above the said upper surface, and means for retracting said finger when the said stud has been sheared.

8. The improvement of claim 7 wherein the means for retracting said finger is an index cylinder operatively connected to a pump actuated in response to the movement of said blade through said stud.

9. The improvement of claim 1 wherein the said stationary die plates have openings generally configured like but oversized with respect to the openings in the shear plates.

10. The improvement of claim 1 wherein the said openings of said shear plates have inverted L-shaped openings to receive said stud, said openings defined by spaced, substantially vertical surfaces and substantially horizontal surfaces defining flange-supporting lips.

* * * * *

UNITED STATES PATENT AND TRADEMARK OFFICE

CERTIFICATE OF CORRECTION

PATENT NO. : 6,761,100 B1
DATED : July 13, 2004
INVENTOR(S) : Melbourne F. Giberson It is certified that error appears in the above-identified patent and that said Letters Patent is hereby corrected as shown below:

Column 4,
Line 20, replace “threads.85” with -- threads 85 --
Line 52, replace “fluid pressure,” with -- fluid under pressure, --
Line 56, replace “space betwen the” with -- space between the --
Line 57, replace “shearing and stud” with -- shearing any stud --
Line 63, replace “The cyliner 101” with -- The cylinder 101 --

Column 5,
Line 37, replace “opining” with -- opening --

Column 6,
Line 3, replace “preferred, stationary” with -- preferred, the stationary --

Signed and Sealed this

Thirty-first Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,761,100 B1
DATED : July 13, 2004
INVENTOR(S) : Harold Oncken

It is certified that error appears in the above-identified patent and that said Letters Patent is hereby corrected as shown below:

Column 4,
Line 20, replace “threads.85” with -- threads 85 --
Line 52, replace “fluid pressure,” with -- fluid under pressure, --
Line 56, replace “space betwen the” with -- space between the --
Line 57, replace “shearing and stud” with -- shearing any stud --
Line 63, replace “The cyliner 101” with -- The cylinder 101 --

Column 5,
Line 37, replace “opining” with -- opening --

Column 6,
Line 3, replace “preferred, stationary” with -- preferred, the stationary --

This certificate supersedes Certificate of Correction issued August 31, 2004.

Signed and Sealed this

Nineteenth Day of October, 2004

JON W. DUDAS
*Director of the United States Patent and Trademark Office*